US011370232B2

(12) United States Patent
Ao et al.

(10) Patent No.: US 11,370,232 B2
(45) Date of Patent: Jun. 28, 2022

(54) MEDIUM TRANSPORT DEVICE AND RECORDING APPARATUS

(71) Applicant: SEIKO EPSON CORPORATION, Tokyo (JP)

(72) Inventors: Junko Ao, Shiojiri (JP); Koji Oda, Shiojiri (JP); Toshihiro Imae, Matsumoto (JP); Soichiro Kii, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 89 days.

(21) Appl. No.: 16/796,710

(22) Filed: Feb. 20, 2020

(65) Prior Publication Data

US 2020/0269610 A1 Aug. 27, 2020

(30) Foreign Application Priority Data

Feb. 22, 2019 (JP) ..... JP2019-030236

(51) Int. Cl.
*B41J 11/00* (2006.01)

(52) U.S. Cl.
CPC ..... *B41J 11/0095* (2013.01)

(58) Field of Classification Search
CPC .. B41J 11/0095; B41J 11/009; B41J 13/0009; B41J 15/04; B41J 11/0045; B41J 29/38; B41J 29/393
See application file for complete search history.

(56) References Cited

FOREIGN PATENT DOCUMENTS

| | | | |
|---|---|---|---|
| JP | 2000289888 A | * | 10/2000 |
| JP | 2013-234059 | | 11/2013 |
| JP | 2013234059 A | * | 11/2013 |
| JP | 2017-226499 | | 12/2017 |

* cited by examiner

*Primary Examiner* — Jannelle M Lebron
(74) *Attorney, Agent, or Firm* — Workman Nydegger

(57) ABSTRACT

The medium detection unit is a component constituting an optical path of the detection light, and includes a first optical element disposed on an upper side of the medium transport path and a second optical element disposed on a lower side of the medium transport path so as to face the first optical element, the second optical element has a facing surface that faces the first optical element, the facing surface being located at a position that is not in contact with a medium nipped by both the first roller pair and the second roller pair, and a medium feeding direction by the first roller pair is a direction by which a leading edge of a medium fed out abuts a position upstream in the medium transport direction relative to a position where the detection light is received on the facing surface.

16 Claims, 13 Drawing Sheets

MEDIUM TRANSPORT DEVICE AND RECORDING APPARATUS

The present application is based on, and claims priority from JP Application Serial Number 2019-030236, filed Feb. 22, 2019, the disclosure of which is hereby incorporated by reference herein in its entirety.

BACKGROUND

1. Technical Field

The present disclosure relates to a medium transport device that transports a medium, and a recording apparatus including the same.

2. Related Art

In recording apparatuses such as facsimile machines and printers, a detection unit is provided in a sheet transport path to detect passage of the leading edge or trailing edge of a sheet, which is an example of a medium. Such a detection unit includes, for example, an optical sensor composed of a pair of a light emitting element that emits sensor light toward a medium transport path, and a light receiving element that receives light emitted by the light emitting element. JP-A-2017-226499 is an example of the related art.

When a paper sheet is transported in the medium transport path, paper dust may be generated from the sheet. Accordingly, the paper dust may adhere to constitutional parts of the optical sensor, which causes reduced detection capability. In the medium transport device described in JP-A-2017-226499, the medium transport path is composed of an upper guide member and a lower guide member, and the lower guide member includes a light transmissive member that transmits sensor light, which is disposed on a transport surface. The sensor light transmission surface of the light transmissive member is set to a level slightly higher than the transport surface so that paper dust deposited and adhered to the sensor light transmission surface is removed by a sheet. In this configuration, however, the sheet transported is always in contact with the sensor light transmission surface, so the sensor light transmission surface is subject to abrasion damage, leading to reduced detection capability. In addition, since the sheet transported is always in contact with the sensor light transmission surface, there may be a case that the transport load of the sheet increases or a sheet is rubbed and damaged.

SUMMARY

A medium transport device of the present disclosure for overcoming the above issues includes: a medium transport path that transports a medium, the medium transport path extending in a direction intersecting a vertical direction; a first roller pair that imparts a feeding force to a medium in the medium transport path; a second roller pair that imparts a feeding force to a medium in the medium transport path, the second roller pair being disposed downstream relative to the first roller pair in a medium transport direction; and a medium detection unit that detects a medium by using detection light intersecting the medium transport path, the medium detection unit being disposed between the first roller pair and the second roller pair in the medium transport path, wherein the medium detection unit is a component constituting an optical path of the detection light, and includes a first optical element disposed on an upper side of the medium transport path and a second optical element disposed on a lower side of the medium transport path so as to face the first optical element, the second optical element has a facing surface that faces the first optical element, the facing surface being located at a position that is not in contact with a medium nipped by both the first roller pair and the second roller pair, and a medium feeding direction by the first roller pair is a direction by which a leading edge of a medium fed out abuts a position upstream in the medium transport direction relative to a position where the detection light is received on the facing surface.

DESCRIPTION OF EXEMPLARY EMBODIMENTS

Figure 1:
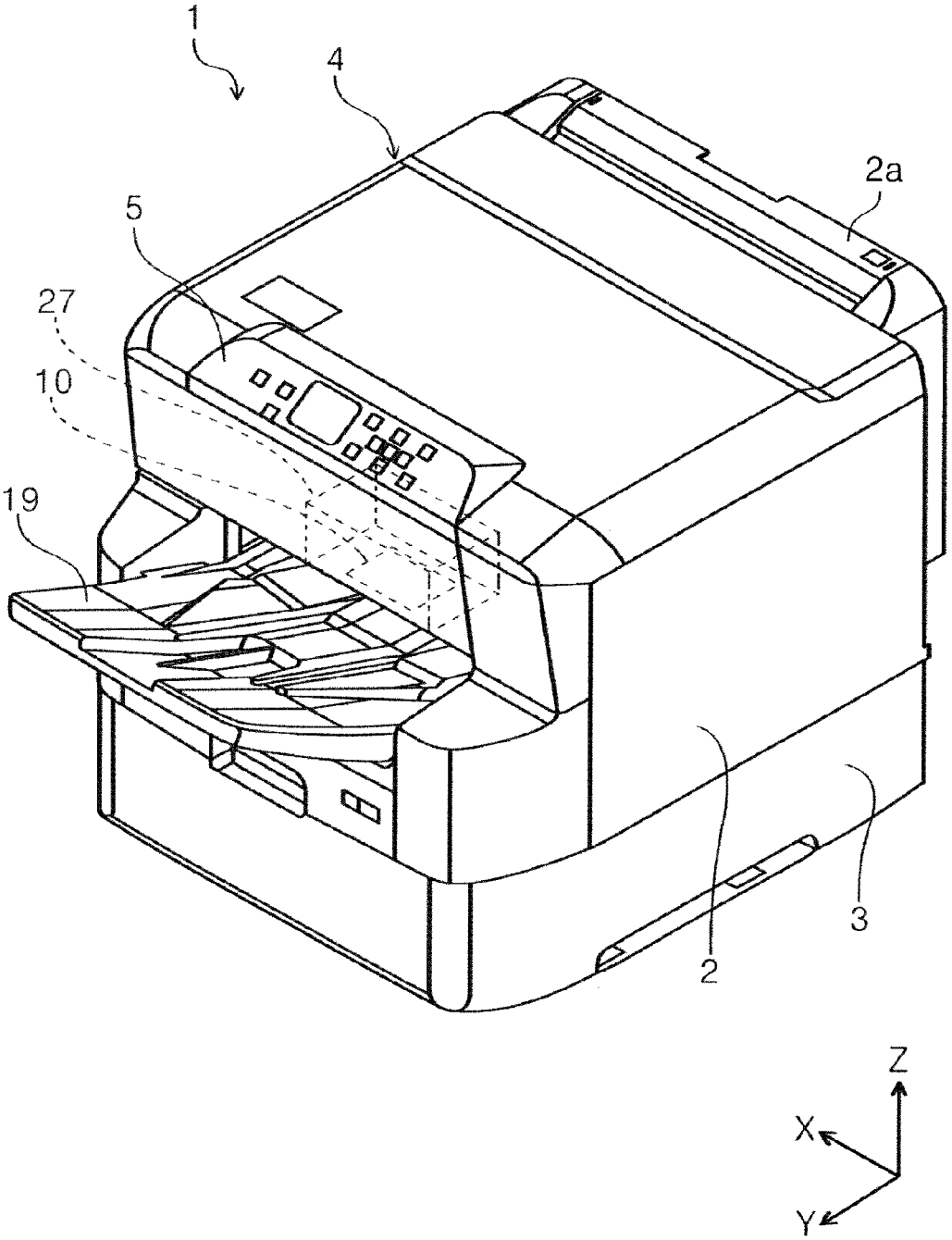
FIG. 1 is a perspective view of an appearance of a printer.

The present disclosure will be schematically described. A medium transport device according to a first aspect includes: a medium transport path that transports a medium, the medium transport path extending in a direction intersecting a vertical direction; a first roller pair that imparts a feeding force to a medium in the medium transport path; a second roller pair that imparts a feeding force to a medium in the medium transport path, the second roller pair being disposed downstream relative to the first roller pair in a medium transport direction; and a medium detection unit that detects a medium by using detection light intersecting the medium transport path, the medium detection unit being disposed between the first roller pair and the second roller pair in the medium transport path, wherein the medium detection unit is a component constituting an optical path of the detection light, and includes a first optical element disposed on an upper side of the medium transport path and a second optical element disposed on a lower side of the medium transport path so as to face the first optical element, the second optical element has a facing surface that faces the first optical element, the facing surface being located at a position that is not in contact with a medium nipped by both the first roller pair and the second roller pair, and a medium feeding direction by the first roller pair is a direction by which a leading edge of a medium fed out abuts a position upstream in the medium transport direction relative to a position where the detection light is received on the facing surface.

According to this aspect, since the second optical element is located at a position that is not in contact with a medium nipped by both the first roller pair and the second roller pair, the second optical element is not subject to abrasion damage by the medium. Since a medium feeding direction by the first roller pair is a direction by which a leading edge of a medium fed out abuts a position upstream in the medium transport direction relative to a position where the detection light is received on the facing surface, foreign substances such as paper dust attached to the facing surface can be removed by the leading edge of the medium.

A second aspect is the medium transport device according to the first aspect, wherein the facing surface is a flat surface, and has inclination in which a downstream end in the medium transport direction is located higher than an upstream end in the medium transport direction. According to this aspect, since the facing surface is a flat surface, and has inclination in which a downstream end in the medium transport direction is located higher than an upstream end in the medium transport direction, foreign substances such as paper dust attached to the facing surface can be shaken off, for example, by vibration or impact applied by the apparatus.

A third aspect is the medium transport device according to the second aspect, wherein the facing surface is configured to guide a leading edge of a medium to a medium nip position in the second roller pair. According to this aspect, since the facing surface is configured to guide a leading edge of a medium to a medium nip position in the second roller pair, the leading edge of the medium can be reliably urged to reach the second roller pair.

A medium transport device according to a fourth aspect includes: a medium transport path that transports a medium, the medium transport path extending in a direction intersecting a vertical direction; a first roller pair that imparts a feeding force to a medium in the medium transport path; a second roller pair that imparts a feeding force to a medium in the medium transport path, the second roller pair being disposed downstream relative to the first roller pair in a medium transport direction; and a medium detection unit that detects a medium by using detection light intersecting the medium transport path, the medium detection unit being disposed between the first roller pair and the second roller pair in the medium transport path, wherein the medium detection unit is a component constituting an optical path of the detection light, and includes a first optical element disposed on an upper side of the medium transport path and a second optical element disposed on a lower side of the medium transport path so as to face the first optical element, the second optical element has a facing surface that faces the first optical element, the facing surface being located at a position that does not contact a medium nipped by both the first roller pair and the second roller pair, the medium transport device includes a contact unit that is displaceable between a first position that is advanced toward the facing surface and a second position that is retracted from the first position, farther away from the facing surface, and the contact unit is configured to bring a medium whose leading edge at the first position is located between the first roller pair and the second roller pair into contact with the facing surface.

According to this aspect, since the medium transport device includes a contact unit configured to bring a medium whose leading edge is located between the first roller pair and the second roller pair into contact with the facing surface, foreign substances such as paper dust attached to the facing surface can be removed by the medium. Further, the contact unit is displaceable between a first position that is advanced toward the facing surface and a second position that is retracted from the first position, farther away from the facing surface. Accordingly, the contact unit is prevented from being always in contact with a recording surface of the medium and causing abrasion damage thereto.

A fifth aspect is the medium transport device according to the fourth aspect, wherein the contact unit is switched between the first position at which the contact unit is pressed toward the facing surface and causes a leading edge of a medium located between the first roller pair and the second roller pair to be in contact with the facing surface, and the second position at which the contact unit is pushed up by a medium nipped by the first roller pair and the second roller pair and causes the medium not to be in contact with the facing surface. Since the contact unit is switched between the first position and the second position when it is pressed toward the facing surface and pushed up by the medium, the contact unit can be easily displaced.

A sixth aspect is the medium transport device according to the fourth aspect, further including a switching unit that switches a position of the contact unit, wherein the switching unit causes the contact unit to be located at the first position in a state in which a leading edge of a medium is located between the first roller pair and the second roller pair, and causes the contact unit to be located at the second position after a leading edge of the medium reaches the second roller pair.

According to this aspect, the contact unit is configured to be switched between the first position and the second position by the switching unit, and the switching unit causes the contact unit to be located at the first position in a state in which a leading edge of a medium is located between the first roller pair and the second roller pair, and causes the contact unit to be located at the second position after a leading edge of the medium reaches the second roller pair. Accordingly, the medium is not always in contact with the second optical element, and thus abrasion damage to the second optical element by the medium can be reduced.

A seventh aspect is the medium transport device according to the fourth aspect, further including a switching unit that switches a position of the contact unit, wherein the switching unit, when transporting a plurality of media, displaces the contact unit from the second position to the first position during transport of a first medium among the plurality of media, and holds the contact unit at the second position during transport of a second medium, which is different from the first medium among the plurality of media.

According to this aspect, the contact unit is configured to be switched between the first position and the second position by the switching unit, and the switching unit, when transporting a plurality of media, displaces the contact unit from the second position to the first position during transport of a first medium among the plurality of media, and holds the contact unit at the second position during transport of a second medium, which is different from the first medium among the plurality of media. Accordingly, when the plurality of media are transported, all the media are not always in contact with the second optical element, and thus abrasion damage to the second optical element by the media can be reduced.

An eighth aspect is the medium transport device according to the seventh aspect, wherein the first medium is a medium that is first transported among the plurality of media. According to this aspect, since the first medium is a medium that is first transported among the plurality of media, the second and the subsequent media transported can be appropriately detected by the second optical element in good condition.

A ninth aspect is the medium transport device according to the seventh or eighth aspect, wherein the switching unit causes the contact unit to be located at the first position in a state in which a leading edge of the first medium is located between the first roller pair and the second roller pair, and causes the contact unit to be located at the second position after a leading edge of the first medium reaches the second roller pair.

According to this aspect, the switching unit causes the contact unit to be located at the first position in a state in which a leading edge of the first medium is located between the first roller pair and the second roller pair, and causes the contact unit to be located at the second position after a leading edge of the first medium reaches the second roller pair. Accordingly, the medium is not always in contact with the second optical element, and thus abrasion damage to the second optical element by the medium can be reduced.

A tenth aspect is the medium transport device according to any one of the fourth to ninth aspects, wherein the contact unit is composed of a driven roller that is driven while being in contact with a medium. According to this aspect, since the contact unit is composed of a driven roller that is driven while being in contact with a medium, abrasion damage to a medium by the contact unit can be reduced.

An eleventh aspect is the medium transport device according to any one of the first to tenth aspects, wherein a transport rate of a medium by the second roller pair is higher than a transport rate of a medium by the first roller pair. According to this aspect, since a transport rate of a medium by the second roller pair is higher than a transport rate of a medium by the first roller pair, a medium nipped between the first roller pair and the second roller pair can be prevented from sagging between these roller pairs and contacting the facing surface. As a result, abrasion damage to the facing surface by the medium can be reduced.

A twelfth aspect is the medium transport device according to any one of the first to eleventh aspects, further including a first rib that supports a medium on a first side of the facing surface in a width direction, which is a direction intersecting a medium transport direction, and a second rib that supports a medium on a second side of the facing surface, which is a side opposite to the first side in the width direction.

According to this aspect, the medium transport device further includes a first rib that supports a medium on a first side of the facing surface in a width direction, which is a direction intersecting a medium transport direction, and a second rib that supports a medium on a second side of the facing surface, which is a side opposite to the first side in the width direction. Accordingly, a medium sags between two ribs so that the medium can be appropriately in contact with the facing surface.

A thirteenth aspect is the medium transport device according to any one of the first to twelfth aspects, wherein the second optical element is displaceable in a direction advanced and retracted with respect to the first optical element, and is pressed toward the first optical element.

According to this aspect, the second optical element is displaceable in a direction advanced and retracted with respect to the first optical element, and is pressed toward the first optical element. Accordingly, when the medium is in strong contact with the second optical element, that is, the facing surface, the facing surface can be retracted. As a result, abrasion damage to the facing surface by the medium can be reduced. Further, transport failure due to the medium strongly abutting the facing surface can be reduced.

A fourteenth aspect is the medium transport device according to the thirteenth aspect, wherein the second optical element is displaced while keeping a posture of the facing surface relative to the first optical element. If the posture changes when the second optical element is displaced, the traveling direction of the medium, which is fed downstream while being in contact with the facing surface, may be disturbed. According to this aspect, however, such a problem can be reduced.

A recording apparatus according to a fifteenth aspect includes: a recording unit that performs recording on a medium; and the medium transport device according to any one of the first to fourteenth aspects. According to this aspect, in the recording apparatus including the recording section that performs recording on a medium, the advantageous effect which is the same as that of any one of the first to twelfth aspects can be achieved.

The present disclosure will now be specifically described. In the following description, an ink jet printer 1 will be described as an example of the recording apparatus. Hereinafter, the ink jet printer 1 will be simply referred to as a printer 1. In the X-Y-Z coordinate system indicated throughout the drawings, the X axis direction is a scan direction of a recording head 10. The X axis direction is also a width direction of recording paper on which recording is performed, and is also a width direction of the apparatus. When viewed facing the printer 1, the +X direction is the left direction, whereas the −X direction is the right direction. The Y axis direction is a depth direction of the apparatus, and is also a direction extending substantially along a paper sheet transport direction during recording. The +Y direction is a direction directed from the back side to the front side of the apparatus, whereas the −Y direction is a direction directed from the front side to the back side of the apparatus. In the present embodiment, among the side surfaces constituting the printer 1, the side surface on which an output tray 19 is provided is the front surface of the apparatus. The Z axis direction is a direction extending along the vertical direction, and is also a height direction of the apparatus. The +Z direction is a vertically upward direction, whereas the −Z direction is a vertically downward direction.

In the following description, an overall configuration of the printer 1 will now be described with reference to FIGS. 1 to 3. The printer 1 shown in FIG. 1 includes a recording unit 2 and a liquid storage unit 3. The recording unit 2 includes various components therein, which include a recording head 10 that performs recording on the recording paper, which is an example of a medium, and a paper sheet transport device 9 (FIG. 2) having a transport path for transporting the recording paper. In the sense that the printer 1 transports recording paper, it can also be generally regarded as a transport device that transports recording paper.

Figure 3:
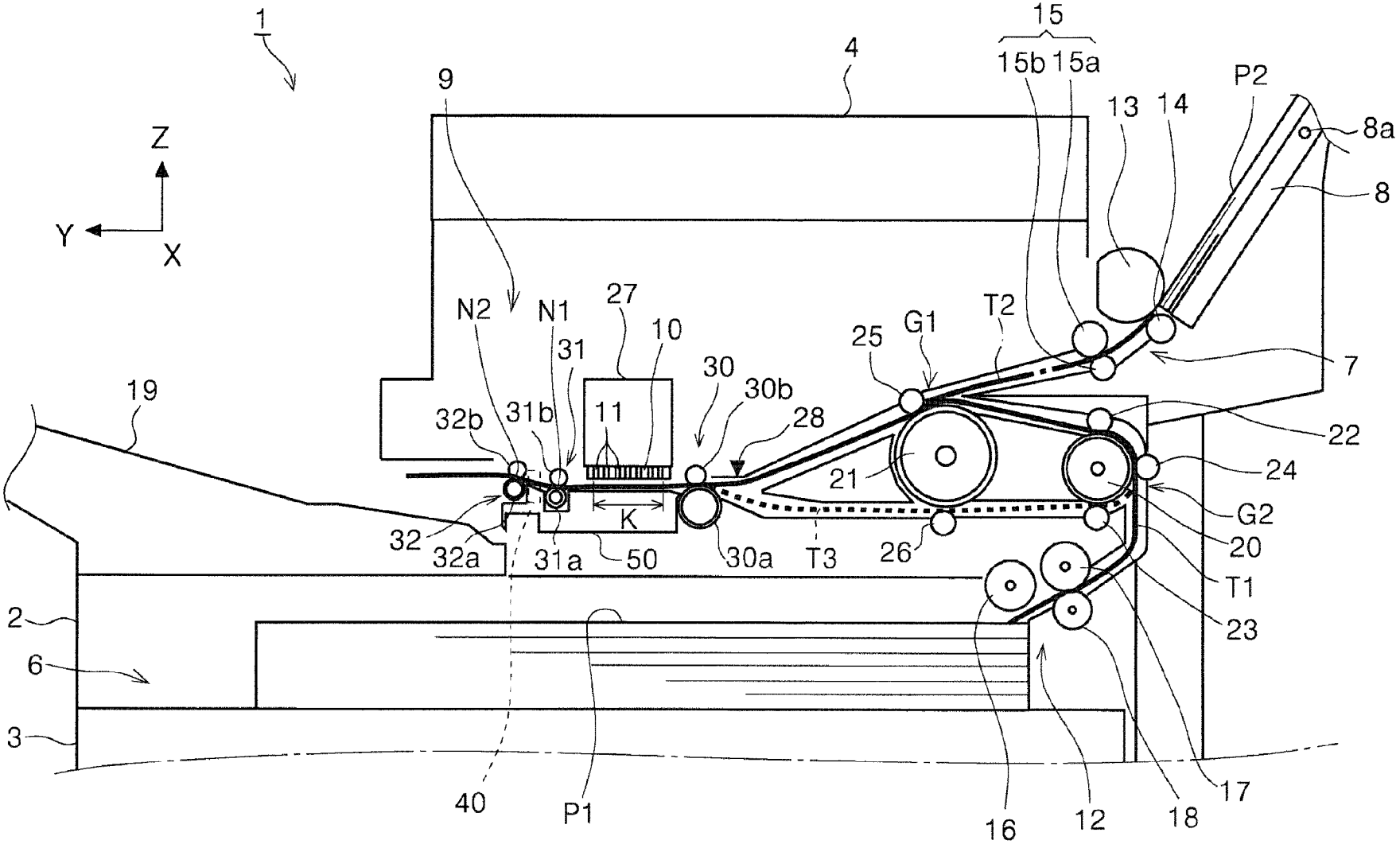
FIG. 3 is a schematic view of a paper sheet transport path of the printer.

As shown in FIG. 3, a plurality of ink ejection nozzles 11 are disposed in the recording head 10. The recording head 10 is mounted on a carriage 27 that is movable in the X axis direction, and is configured as an ink jet recording head that performs recording onto recording paper by ejecting ink, which is an example of liquid, via the ink ejection nozzles 11 while moving in the X axis direction.

The printer 1 is configured as a multifunction printer having not only a recording function, but also a document reading function, that is, a scanner. In the present embodiment, a scanner unit 4 is disposed in an upper part of the recording unit 2. In FIGS. 1 to 3, the detailed configuration of the scanner unit 4 is not illustrated. As shown in FIG. 1, an operation unit 5 for operating the printer 1 including the scanner unit 4 is disposed in an upper front part of the apparatus.

The liquid storage unit 3 shown in FIG. 1 accommodates a liquid container, which is not shown, that stores ink to be supplied to the recording head 10. Ink is supplied from the liquid container accommodated in the liquid storage unit 3 to the recording head 10 via a tube, which is not shown.

Figure 2:
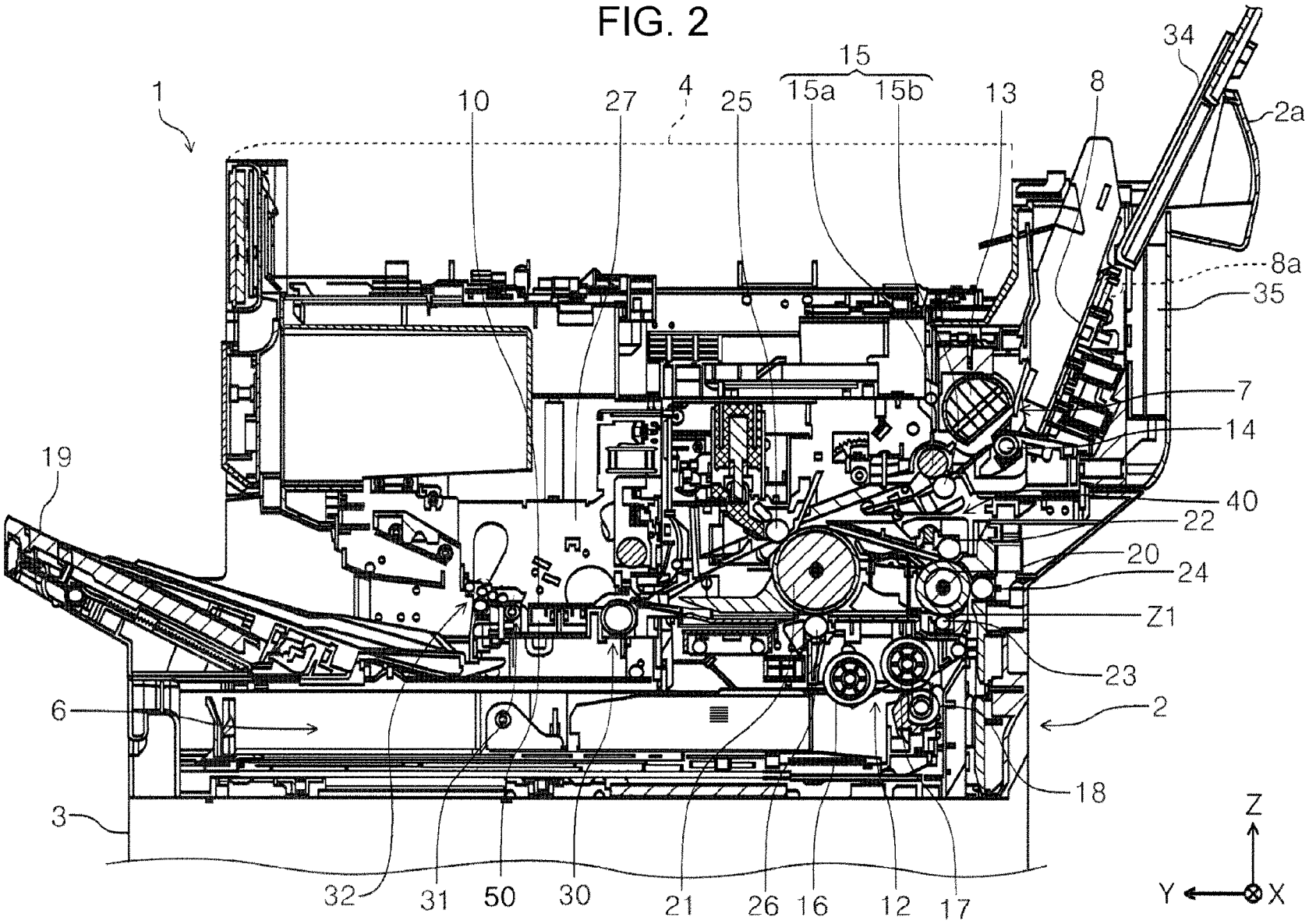
FIG. 2 is a side cross-sectional view of the printer.

The recording unit 2 includes an upper supply mechanism 7 that supplies recording paper toward the recording head 10 shown in FIG. 2. An upper cover 2*a* is provided in an upper rear part of the apparatus so as to openably close a paper sheet setting unit 8 that is used for setting recording paper in the upper supply mechanism 7 shown in FIG. 2. When the upper cover 2*a* is opened as shown in FIG. 2, recording paper can be set in the paper sheet setting unit 8.

Further, as shown in FIG. 2, a paper sheet tray 6 is disposed in the lower part of the recording unit 2. A lower supply mechanism 12 is provided to supply recording paper from the paper sheet tray 6 toward the recording head 10. The recording head 10 performs recording onto the recording paper supplied by the upper supply mechanism 7 or the lower supply mechanism 12. In addition to the paper sheet tray 6 built in the recording unit 2, the printer 1 may also include an additional paper sheet accommodating unit (not shown) in the lower part of the recording unit 2 or in the lower part of the liquid storage unit 3.

Next, with reference to FIG. 3, a paper sheet transport path of the paper sheet transport device 9 for transporting recording paper in the printer 1 will be described. In FIG. 3, the solid line denoted by reference numeral T1 indicates the transport path for recording paper fed from the paper sheet tray 6 by the lower supply mechanism 12. Hereinafter, the path is referred to as a paper sheet transport path T1. Further, the dot and dashed line denoted by reference numeral T2 indicates the transport path for recording paper fed by the upper supply mechanism 7. Hereinafter, the path is referred to as a paper sheet transport path T2.

Further, the printer 1 is configured to perform double-sided recording by performing printing on a first surface of recording paper and then reversing the recording paper to perform recording on a second surface, which is a surface opposite to the first surface. The dotted line denoted by the reference numeral T3 in FIG. 3 indicates a switchback path along which the recording paper passes when the recording paper is reversed after recording is performed on the first surface in double-sided recording. Hereinafter, the path is referred to as a switchback path T3.

In the paper sheet transport device 9, a detection unit 40 is provided to detect passage of a leading edge and a trailing edge of recording paper in the paper sheet transport path. The detail of the detection unit 40, which is a feature of the present disclosure, will be described after the description of the paper sheet transport path. The description will be made in the order of the paper sheet transport path T1, the paper sheet transport path T2, and the switchback path T3.

The paper sheet transport path T1 includes the lower supply mechanism 12, a reversing roller 20, a feeding roller 21, an upstream transport roller pair 30, a first transport roller pair 31 as a first roller pair, and a second transport roller pair 32 as a second roller pair, which constitute the paper sheet transport device 9.

Reference numeral P1 represents a paper sheet bundle set in the paper sheet tray 6. The lower supply mechanism 12 feeds the paper sheets one by one from the paper sheet bundle P1 set in the paper sheet tray 6. The lower supply mechanism 12 includes a pick-up roller 16, a lower feed roller 17, and a lower separation roller 18.

The paper sheets in the paper sheet bundle P1 accommodated in the paper sheet tray 6 are picked up from the paper sheet tray 6 by the pick-up roller 16, and are fed toward the reversing roller 20 while being nipped between the lower feed roller 17 and the lower separation roller 18. The reversing roller 20 is a roller that transports recording paper while reversing the recording paper on the outer peripheral surface. The rollers denoted by reference numerals 22 and 24 are a first reverse driven roller and a third reverse driven roller, respectively, that cooperate with the reversing roller 20 to nip the recording paper therebetween. The recording paper is reversed by the reversing roller 20, and is fed toward the feeding roller 21 with a surface that has been upward in the paper sheet tray 6 oriented downward.

The feeding roller 21 is disposed downstream of the reversing roller 20. Further, the reversing roller 20 and the feeding roller 21 are driven by a driving source, which is not shown. The roller denoted by reference numeral 25 is a first feeding driven roller that cooperates with the feeding roller 21 to nip the recording paper therebetween. The recording paper is fed to the upstream transport roller pair 30 located downstream of the feeding roller 21 while being nipped between the feeding roller 21 and the first feeding driven roller 25. The upstream transport roller pair 30 is composed of a driving roller 30*a* and a driven roller 30*b*. Further, a paper sheet detection sensor 28 that detects passage of recording paper is disposed upstream of the upstream transport roller pair 30.

The first transport roller pair 31 and the second transport roller pair 32 that transport recording paper are disposed downstream of the recording head 10 in the paper sheet transport direction. The first transport roller pair 31 is composed of a first transport driving roller 31*a* and a first transport driven roller 31*b*. The second transport roller pair 32 is composed of a second transport driving roller 32*a* and a second transport driven roller 32*b*. The driving roller 30*a*, the first transport driving roller 31*a*, and the second transport driving roller 32*a* are each rotationally driven by a motor, which is not shown.

A support member 50, which is a medium support section that supports recording paper, is disposed at a position facing the recording head 10. While the recording paper supported by the support member 50 passes through a recording region K, recording is performed on the recording paper by ejecting ink from the plurality of ink ejection nozzles 11 of the recording head 10. After recording is performed by the recording head 10, the recording paper is outputted into the output tray 19 by the first transport roller pair 31 and the second transport roller pair 32.

Next, with reference to FIG. 3 as well, a paper sheet transport path T2, which is a transport path for recording paper fed from the paper sheet setting unit 8 by the upper supply mechanism 7 will be described. The recording paper fed by the upper supply mechanism 7 is set in the paper sheet setting unit 8. A plurality of sheets of recording paper can be set in the paper sheet setting unit 8. In FIG. 3, reference numeral P2 represents a paper sheet bundle set in the paper sheet setting unit 8. It should be noted that a single sheet of recording paper can also be set in the paper sheet setting unit 8.

The paper sheet setting unit 8 is formed as a hopper that swings relative to the rotation shaft 8*a* disposed upstream in the paper sheet transport direction. As shown in FIG. 2, a paper support 34 that supports the trailing edge of the paper sheet bundle P2 is disposed upstream of the paper sheet setting unit 8. The paper support 34 is configured to be housed in a housing section 35 located under the paper support 34 in FIG. 2, and to be pulled out from the housing section 35. When a paper sheet is supplied by the upper supply mechanism 7, the paper support 34 is pulled out from the housing section 35. When the upper supply mechanism 7 is not used, the paper support 34 can be housed in the housing section 35 so that the upper cover 2*a* can be closed.

Referring back to FIG. 3, an upper feed roller 13, an upper separation roller 14, and a downstream feed roller pair 15, which constitute the upper supply mechanism 7, are disposed downstream of the paper sheet setting unit 8. The paper sheet setting unit 8 swings so that the distal end thereof approaches the upper feed roller 13. The upper feed roller 13 rotates to cause an uppermost sheet of recording paper of the paper sheet bundle P2 set in the paper sheet setting unit 8 to be fed downstream. The upper separation roller 14 cooperates with the upper feed roller 13 to nip a sheet of recording paper therebetween to thereby separate a single sheet from a plurality of sheets of recording paper. The recording paper fed by the upper feed roller 13 is further fed downstream by the downstream feed roller pair 15. The downstream feed roller pair 15 is composed of a driving roller 15*a* and a driven roller 15*b* that rotates driven by the driving roller 15*a*.

The paper sheet transport path T2 joins the paper sheet transport path T1 described above at a first joining section G1, which is located upstream of a nip position between the feeding roller 21 and the first feeding driven roller 25. The recording paper transported along the paper sheet transport path T2 enters the paper sheet transport path T1 via the first joining section G1, and is then fed into the recording region K by the upstream transport roller pair 30 as with the case of the recording paper fed from the paper sheet tray 6. After recording is performed by the recording head 10, the recording paper is outputted into the output tray 19 by the first transport roller pair 31 and the second transport roller pair 32.

Next, the switchback path T3, which is a transport path in double-sided recording, will be described. In double-sided recording, recording is first performed onto the first surface of the recording paper, and then the upstream transport roller pair 30, the first transport roller pair 31, and the second transport roller pair 32 shown in FIG. 3 are rotated in an opposite direction from the rotation direction during the recording onto the first surface. Accordingly, the recording paper is transported in the −Y direction, which is opposite from the +Y direction in which the paper sheet is transported in recording by the recording head 10, and then enters the switchback path T3. In the switchback path T3, the recording paper is transported in the −Y direction while being nipped between the feeding roller 21 and the second feeding driven roller 26, and is then further transported in the −Y direction while being nipped between the reversing roller 20 and the second reverse driven roller 23.

The switchback path T3 joins the paper sheet transport path T1 at a second joining section G2, which is located upstream of a nip position between the reversing roller 20 and the third reverse driven roller 24. When entering the paper sheet transport path T1, the recording paper is reversed and transported being by the reversing roller 20. Accordingly, the recording paper is fed to the recording region K with the first surface, which has been a recording surface, oriented downward, and the second surface oriented upward, that is, facing the recording head 10. After recording is performed onto the second surface of the recording head 10 in the recording region K, the recording paper is outputted into the output tray 19.

Next, the detection unit 40 disposed between the first transport roller pair 31 and the second transport roller pair 32 in the paper sheet transport path T1 of the printer 1 will be described. The detection unit 40 is a unit for detecting recording paper by using detection light that intersects the paper sheet transport path T1. In the present embodiment, the detection unit 40 is an optical sensor. In the following description, the detection unit 40 disposed between the first transport roller pair 31 and the second transport roller pair 32 will be described as an example of the detection unit. However, other detection units (not shown) are further disposed at other positions in the printer 1, and the embodiments described below can be applied to these detection units.

Figure 4:
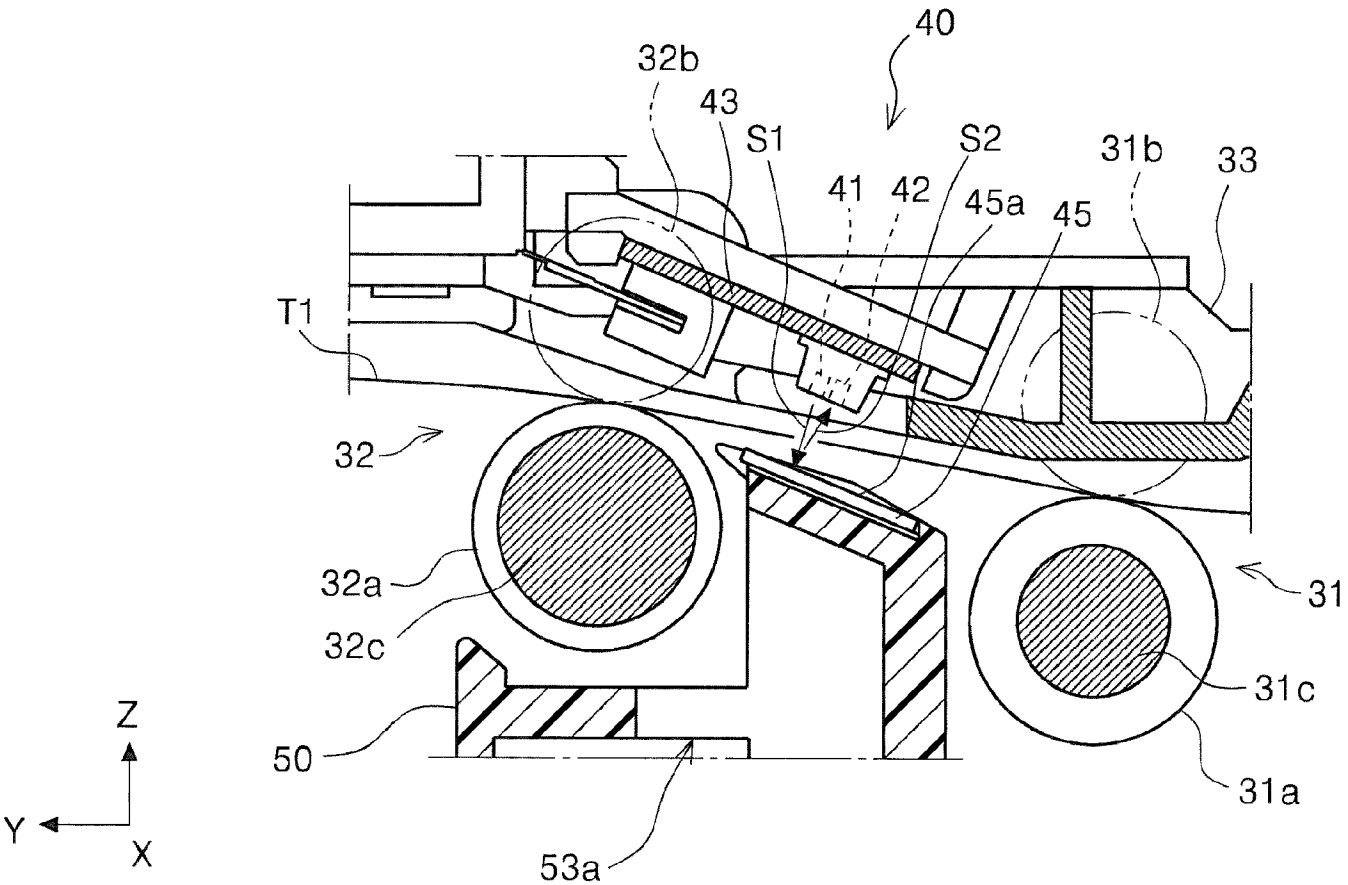
FIG. 4 is a side view of a detection unit.

With reference to FIG. 4 and the subsequent drawings, the details of the detection unit 40 will be described. As shown in FIG. 4, a portion of the paper sheet transport path T1 located between the first transport roller pair 31 and the second transport roller pair 32 extends in a direction intersecting with the vertical direction. In the present embodiment, the path is slightly inclined upward toward the downstream part. As described in connection with FIG. 3, the support member 50 that forms the paper sheet transport path T1 is configured to support the recording paper at a position facing the recording head 10, and support especially the leading edge of the recording paper at a position between the first transport roller pair 31 and the second transport roller pair 32. That is, the support member 50 extends further downstream from the position facing the recording head 10. In the present embodiment, the entirety of the support member 50 is integrally formed of a resin material.

A support member 33 is disposed on the paper sheet transport path T1 at a position between the first transport roller pair 31 and the second transport roller pair 32 such that the first transport driven roller 31*b* and the second transport driven roller 32*b* are supported by the support member 33. Further, the support member 33 is provided with a substrate 43 that constitutes the detection unit 40. The substrate 43 is provided with a light emitting element 41 that emits detection light and a light receiving element 42 that receives detection light. The detection unit 40 is a component constituting an optical path of detection light, and includes a first optical element and a second optical element, which are disposed on the upper side and lower side of the paper sheet transport path T1, respectively. In the present embodiment, the first optical element includes a light emitting element 41 that emits detection light and a light receiving element 42 that receives detection light, and the second optical element includes a reflector 45. The surface of the reflector 45 serves as a reflecting surface 45*a* that reflects detection light. Further, the reflecting surface 45*a* is also a surface facing the first optical element.

Detection light emitted by the light emitting element 41 travels toward the reflector 45. The arrow indicated by reference numeral S1 represents the direction of detection light traveling from the light emitting element 41 toward the reflector 45. The detection light that has reached the reflector 45 is reflected by the reflecting surface 45*a* of the reflector 45, and travels toward the light receiving element 42. The arrow indicated by reference numeral S2 represents the direction of detection light traveling from the reflector 45 toward the light receiving element 42. Further, the reflector 45 has a high reflectivity that allows detection light to be actively reflected. For example, the reflector 45 can be formed of a mirror surface, and, when the recording paper interferes with the optical path of the detection light, the reflectivity relatively decreases so that the passage of the leading edge or trailing edge of the recording paper is detected. Alternatively, the reflector 45 can also be formed of a low reflecting surface such as a black surface or a textured surface, and, when the recording paper interferes with the optical path of the detection light, the reflectivity relatively increases.

Figure 5:
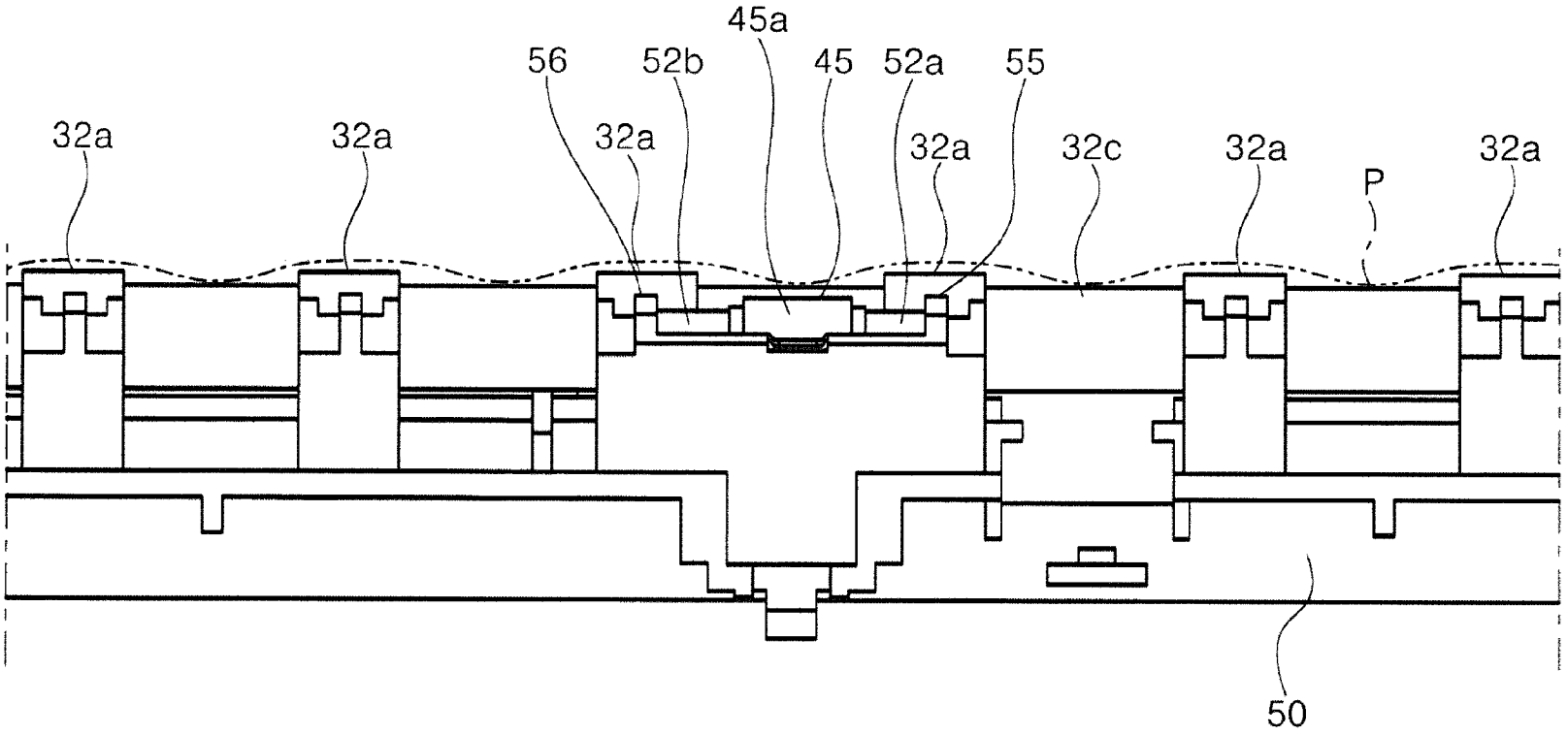
FIG. 5 is a view of a reflector and a low-level section as viewed in the −Y direction.

The attachment structure of the reflector 45 will now be described. As shown in FIG. 5, a plurality of second transport driving rollers 32*a* are disposed about a shaft 32*c* at appropriate intervals in the X axis direction. The recording paper that has absorbed ink is deformed into a wave shape, which is raised at positions of the second transport driving rollers 32*a* and recessed at a position between two second transport driving rollers 32*a*. In FIG. 5, the dot-dot-dashed line indicated by reference numeral P represents the recording paper, which is hereinafter referred to as a recording paper P. The reflector 45 is provided at a position in the X axis direction where the recording paper P is recessed. Similarly, a plurality of first transport driving rollers 31*a* are disposed about a shaft 31*c* (see FIG. 4) at appropriate intervals in the X axis direction. Although not shown in the figure, the positions in the X axis direction are the same as those of the second transport driving rollers 32*a*.

Figure 6:
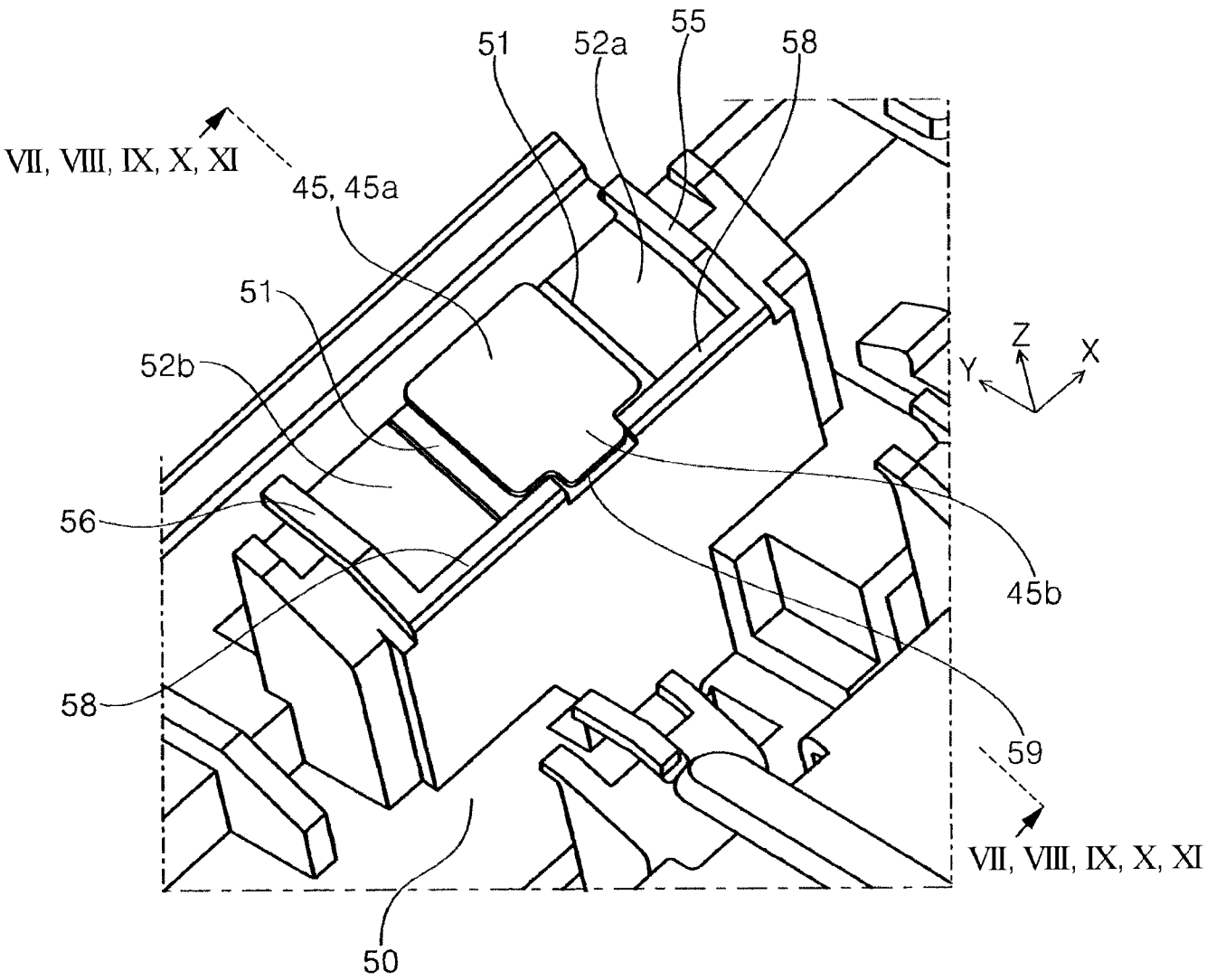
FIG. 6 is a perspective view of the reflector and the low-level section.

As shown in FIG. 6, the support member 50 includes a reflector placing section 51. The reflector placing section 51 is formed as a flat surface such that the reflector 45 is positioned on the top thereof. The reflector 45 can be fixed to the reflector placing section 51 by using a fixation member such as a double-sided tape and an adhesive. A first low-level section 52*a* is provided on a side of the reflector placing section 51 in the +X direction, or a first direction. Further, a second low-level section 52*b* is provided on a side of the reflector placing section 51 in the −X direction, or a second direction. In the present embodiment, the top of the first low-level section 52*a* and the top of the second low-level section 52*b* are both flat, and are located at the same level.

Moreover, a first rib 55 for supporting the recording paper P is disposed on the +X side of the first low-level section 52*a*, and a second rib 56 for supporting the recording paper P is disposed on the −X side of the second low-level section 52*b*. Both the first rib 55 and the second rib 56 extend in the Y axial direction, and has the same height in the Z axis direction.

The first low-level section 52*a* and the second low-level section 52*b* have the height in the Z axis direction lower than that of the reflector placing section 51. The description that the first low-level section 52*a* and the second low-level section 52*b* have the height in the Z axis direction lower than that of the reflector placing section 51 means that the first low-level section 52*a* and the second low-level section 52*b* are at a level lower than the reflector placing section 51 at a position in the Y axis direction. This relationship among the first low-level section 52*a*, the second low-level section 52*b*, and the reflector placing section 51 is established at any position in the Y axis direction.

The reflector placing section 51 has the height lower than that of the first rib 55 and the second rib 56. The description that the reflector placing section 51 has the height lower than that of the first rib 55 and the second rib 56 means that the reflector placing section 51 is at a level lower than the first rib 55 and the second rib 56 at a position in the Y axis direction. This relationship among the reflector placing section 51, the first rib 55, and the second rib 56 is established at any position in the Y axis direction.

Moreover, a regulation rib 58 extending in the X axis direction is disposed on the −Y side of the first low-level section 52*a* and the second low-level section 52*b*. The regulation rib 58 extends upward from the −Y ends of the first low-level section 52*a* and the second low-level section 52*b*. The regulation rib 58 is discontinuous in the X axis direction at the position of the reflector placing section 51, providing a gap 59. The gap 59 receives a protrusion 45*b* of the reflector 45. When the −Y end of the reflector 45 except for the protrusion 45*b* abuts the regulation rib 58, the position of the reflector 45 in the Y axial direction is determined.

According to the present embodiment, the first low-level section 52*a* and the second low-level section 52*b* are located around the reflector 45, which is the second optical element in the support member 50, at a level lower than the reflecting surface 45*a*, which is a light receiving surface for detection light in the reflector 45. Accordingly, foreign substances such as paper dust, if deposited on the first low-level section 52*a* and the second low-level section 52*b*, can be prevented from migrating onto the reflecting surface 45*a* of the reflector 45 and being attached thereto. In particular, since the first rib 55 and the second rib 56 are in contact with the recording paper P, paper dust is likely to be accumulated in the corner formed between the first rib 55 and the first low-level section 52*a* or the corner formed between the second rib 56 and the second low-level section 52*b*. By virtue of the reflector 45 located above the paper dust, foreign substances such as paper dust can be prevented from migrating from the first low-level section 52*a* or the second low-level section 52*b* toward the reflector 45. It should be noted that a plurality of low-level sections can be provided around the reflector 45 as in the present embodiment, or a single low-level section can be provided.

In the present embodiment, the reflecting surface 45*a* is a surface inclined relative to a horizontal direction by a predetermined angle. Specifically, the reflecting surface 45*a* has inclination in which a downstream end 45*e* in the paper sheet transport direction is located higher than an upstream end 45*d*. Accordingly, foreign substances such as paper dust attached to the reflecting surface 45*a* can be shaken off, for example, by vibration or impact applied by the apparatus. Further, the reflecting surface 45*a* is configured to guide the leading edge of the recording paper P to a paper sheet nip position N2 in the second transport roller pair 32 (see FIG. 7). Thus, the leading edge of the recording paper P can be reliably urged to reach the second transport roller pair 32.

Figure 7:
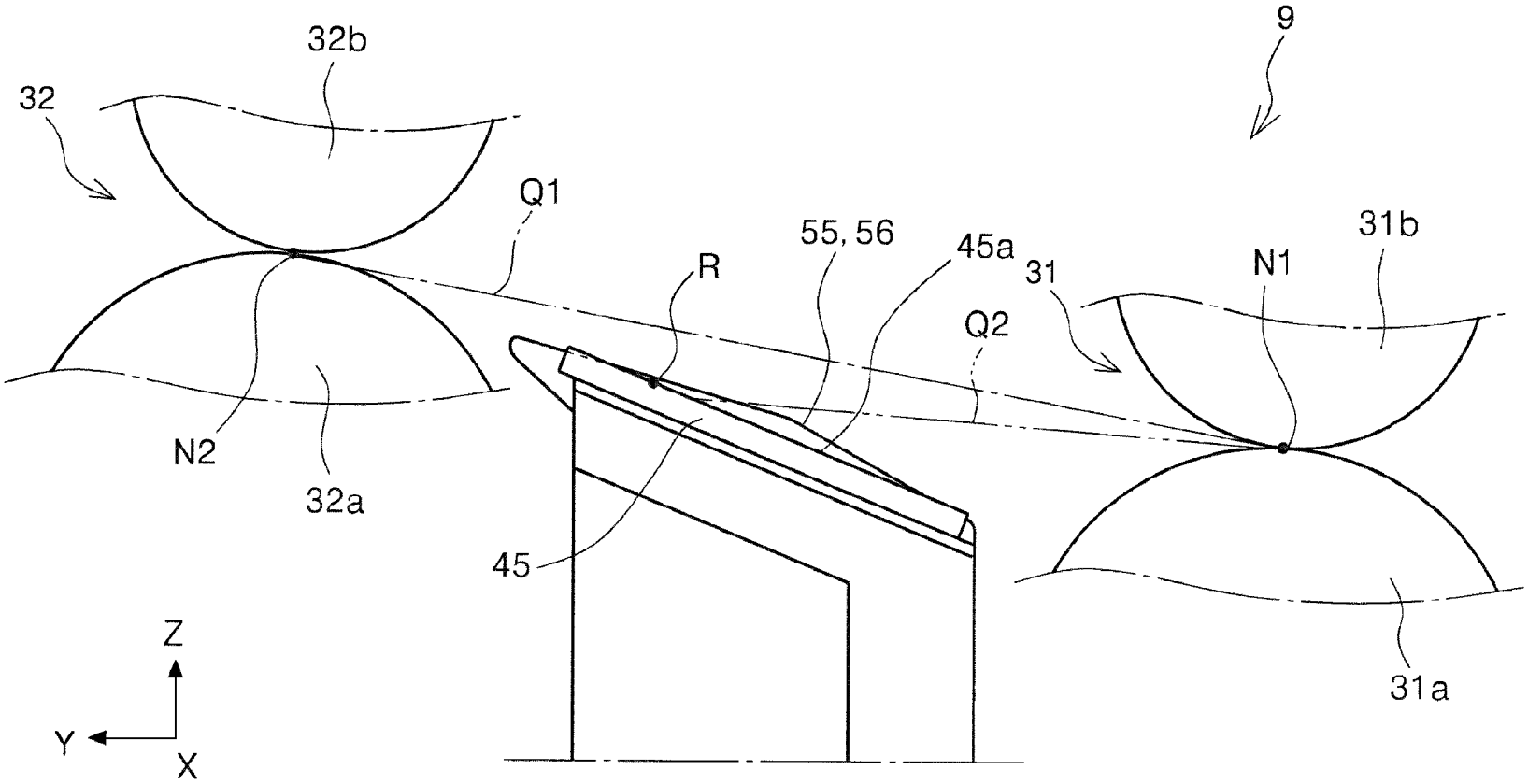
FIG. 7 is a cross-sectional view taken along the line VII-VII of FIG. 6.

Here, the dotted and dashed line indicated by reference numeral Q1 in FIG. 7 is a straight line connecting the paper sheet nip position N1 in the first transport roller pair 31 and the paper sheet nip position N2 in the second transport roller pair 32. In the present embodiment, the straight line Q1 represents the posture of the recording paper P when nipped by both the first transport roller pair 31 and the second transport roller pair 32. The first rib 55, the second rib 56, and the reflecting surface 45*a* are located at positions that do not protrude upward from the straight line Q1. Further, the dot-dot-dashed line indicated by reference numeral Q2 is a common tangent line of the first transport driving roller 31*a* and the first transport driven roller 31*b* at the paper sheet nip position N1 in the first transport roller pair 31, and thus represents a paper sheet feeding direction from the first transport roller pair 31. In the present embodiment, the straight line Q2 intersects the reflecting surface 45*a*. The intersecting position is upstream relative to a light receiving position R of the detection light.

According to the above configuration, since the reflecting surface 45*a* is located at a position that is not in contact with the recording paper P nipped by both the first transport roller pair 31 and the second transport roller pair 32, the reflecting surface 45*a* is not subject to abrasion damage by the recording paper P. Similarly, the recording paper P is also prevented from being damaged due to friction with the reflecting surface 45*a*. In addition, transport failure due to an increase in transport load of the recording paper P can also be reduced. Since the paper sheet feeding direction by the first transport roller pair 31 is a direction by which the leading edge of the recording paper P fed out abuts a position upstream relative to the light receiving position R on the reflecting surface 45*a*, foreign substances such as paper dust attached to the reflecting surface 45*a* can be removed by the leading edge of the recording paper P.

Figure 8:
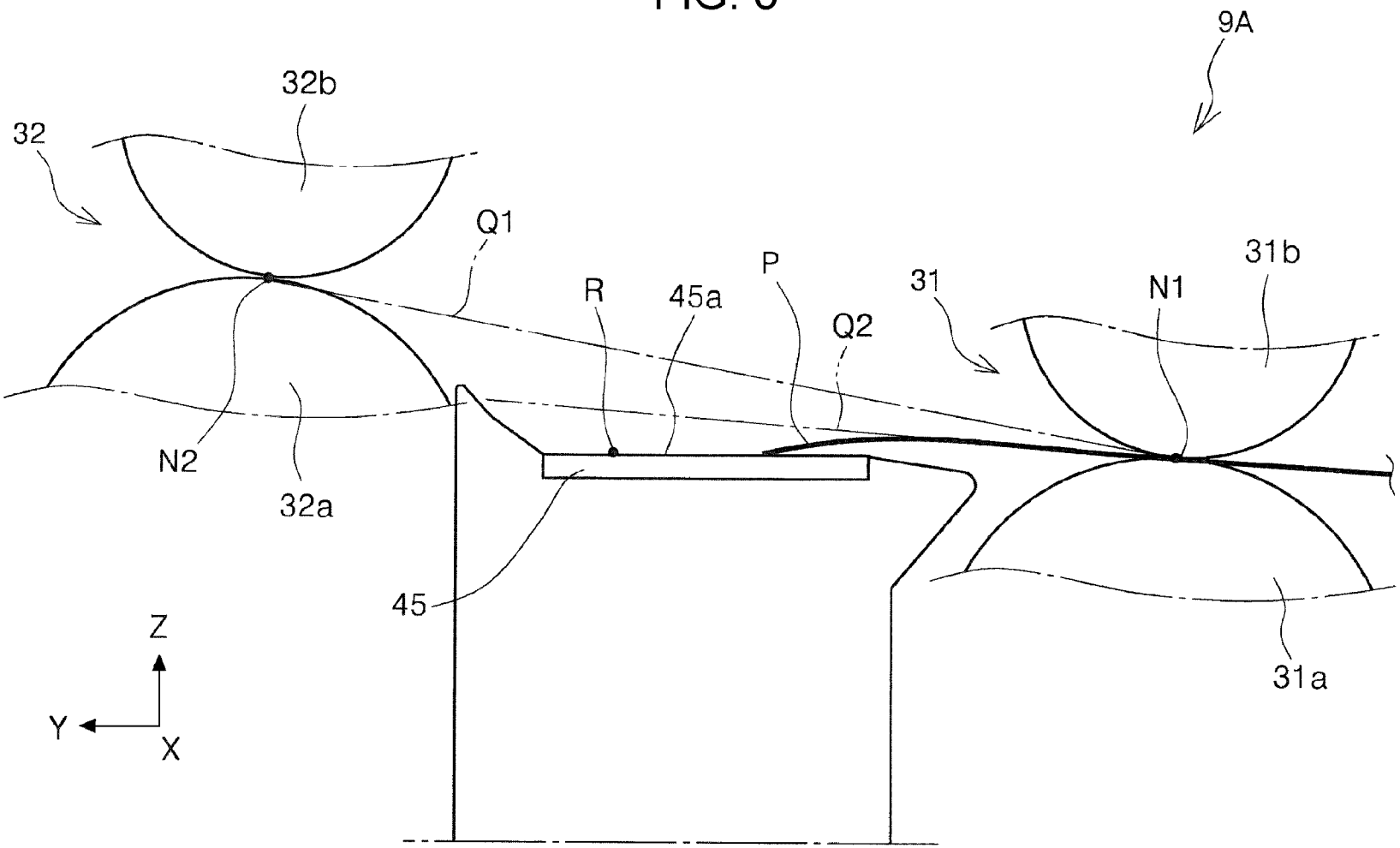
FIG. 8 is a view corresponding to the cross-sectional view taken along the line VIII-VIII of FIG. 6, illustrating another embodiment of a paper sheet transport device.

The paper sheet feeding direction by the first transport roller pair 31, that is, the straight line Q2 does not necessarily intersect the reflecting surface 45*a*. For example, the paper sheet transport device 9A according to another embodiment shown in FIG. 8 has a configuration in which the reflecting surface 45*a* extends along a horizontal plane, and the straight line Q2 does not intersect the reflecting surface 45*a*. In this configuration as well, the leading edge of the recording paper P can be configured to abut the reflecting surface 45*a* by using flexibility of the recording paper P.

Further, in the present embodiment, since the first rib 55 is provided on one side of the reflecting surface 45*a* in the X axis direction and the second rib 56 is provided on the other side without a rib being provided at a position of the reflecting surface 45*a*, the recording paper P sags between the first rib 55 and the second rib 56 so that the recording paper P can be appropriately in contact with the reflecting surface 45*a*.

Figure 9:
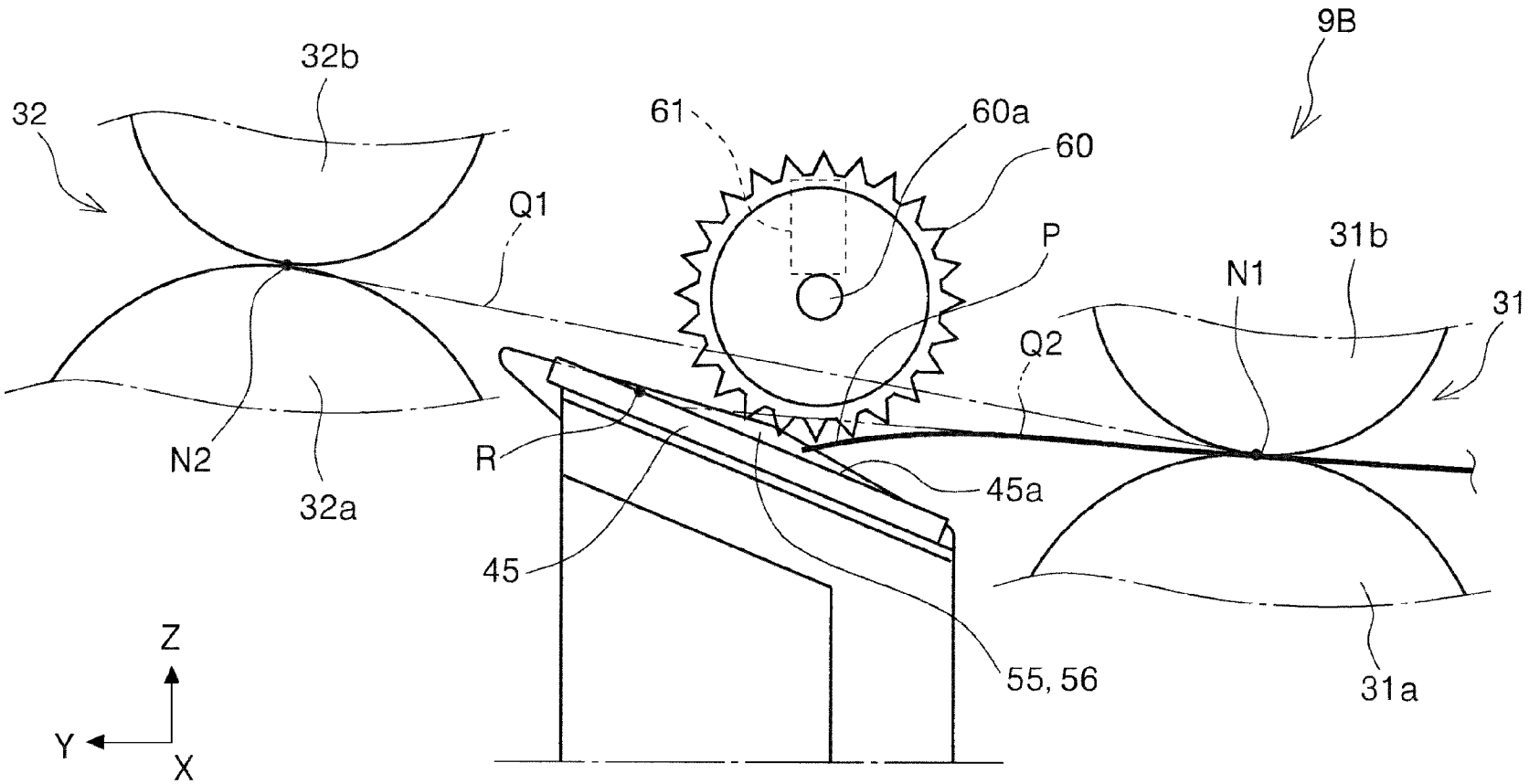
FIG. 9 is a view corresponding to the cross-sectional view taken along the line IX-IX of FIG. 6, illustrating another embodiment of a paper sheet transport device.

Next, with reference to FIG. 9, a paper sheet transport device 9B according to another embodiment will be described. The paper sheet transport device 9B includes a contact unit that is configured to be advanced and retracted with respect to the reflecting surface 45*a*, and is pressed toward the reflecting surface 45*a* so that the recording paper P whose leading edge is located between the first transport roller pair 31 and the second transport roller pair 32 is brought into contact with the reflecting surface 45*a*. The contact unit of the present embodiment is composed of a driven roller 60 that is driven while being in contact with the recording paper P. A rotation shaft 60*a* of the driven roller 60 is configured to be displaceable by a guide, which is not shown, in a direction advanced and retracted with respect to the reflecting surface 45*a*, that is, in the Z axis direction, and is pressed by a pressing spring 61, which is a pressing unit, toward the reflecting surface 45*a*. Further, the driven roller 60 of the present embodiment is composed of a spur that makes point contact with the recording paper P, and a single driven roller 60 is provided at a center of the reflecting surface 45*a* in the X axis direction.

With this configuration, the recording paper P whose leading edge is located at a position between the first transport roller pair 31 and the second transport roller pair 32 can be reliably brought into contact with the reflecting surface 45*a*, and foreign substances such as paper dust attached to the reflecting surface 45*a* can be removed by the recording paper P. Further, the driven roller 60 is configured to be advanced and retracted with respect to the reflecting surface 45*a* and is pressed by the pressing spring 61 toward the reflecting surface 45*a*. Accordingly, when the recording paper P is nipped by both the first transport roller pair 31 and the second transport roller pair 32, the driven roller 60 is pushed upward by the recording paper P. The recording paper P pushing up the driven roller 60 assumes a posture extending along the straight line Q1. Accordingly, abrasion damage to the recording paper P by the reflecting surface 45*a* can also be reduced. Further, a position of the driven roller 60 where it is most advanced toward the reflecting surface 45*a*, that is, the position indicated by the solid line in FIG. 9, is a first position of the driven roller 60. Any position retracted from the first position, farther away from the paper sheet transport path, is a second position of the driven roller 60. Further, instead of the pressing spring 61 being provided to press the driven roller 60, the rotation shaft 60*a* can be as a shaft having elasticity.

Figure 10:
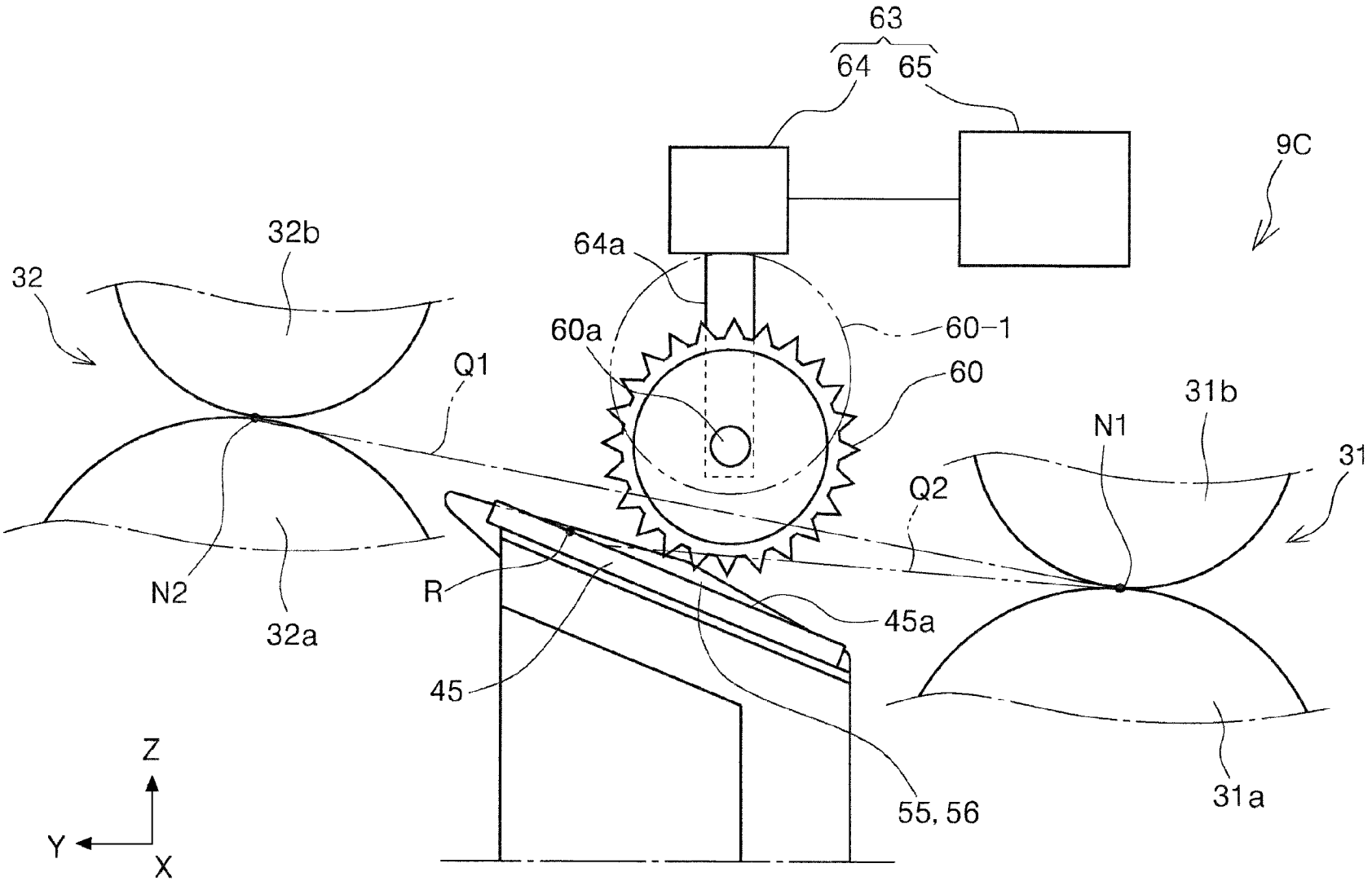
FIG. 10 is a view corresponding to the cross-sectional view taken along the line X-X of FIG. 6, illustrating another embodiment of a paper sheet transport device.

Next, with reference to FIG. 10, a paper sheet transport device 9C according to further another embodiment will be described. The paper sheet transport device 9C differs from the above paper sheet transport device 9B in that the driven roller 60 is configured to be displaced by a switching unit 63. The switching unit 63 includes a solenoid 64, and a control unit 65 that controls the solenoid 64. The solenoid 64 includes a plunger 64*a* that operates as a piston by turning on and off energization, and the plunger 64*a* supports the rotation shaft 60*a* of the driven roller 60. The control unit 65 controls energization of the solenoid 64 to thereby advance and retract the driven roller 60 to and from the reflecting surface 45*a*. The solid line and reference numeral 60 in FIG. 10 indicate the driven roller located at an advanced position, which is the first position, whereas the dot-dot-dashed line and reference numeral 60-1 indicate the driven roller located at a retracted position, which is the second position. When the driven roller 60 is located at the advanced position, the recording paper P can be in contact with the reflecting surface 45*a*. When the driven roller 60 is located at the retracted position, the recording paper P is not in contact with the reflecting surface 45*a* and assumes a posture extending along the straight line Q1. Further, the retracted position of the driven roller 60 is preferably a position that forms a predetermined gap between the driven roller 60 and the recording paper P, that is, a position that is not in contact with the recording paper P.

Figure 12:
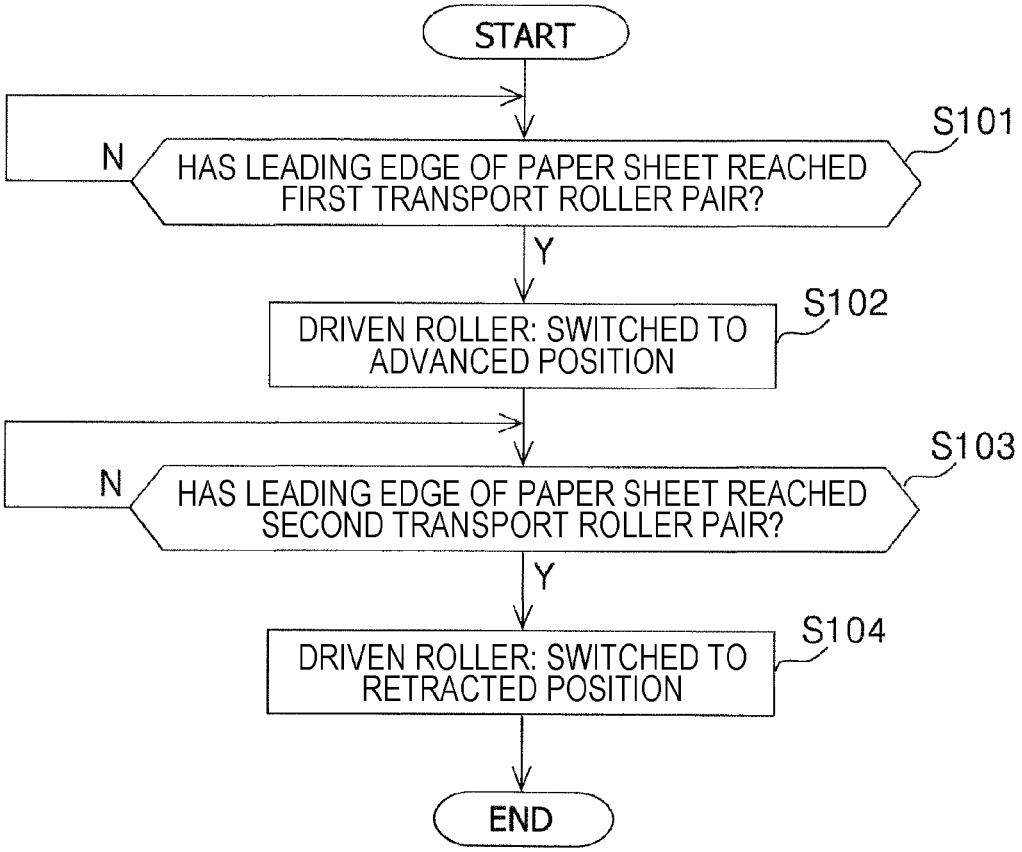
FIG. 12 is a flow chart of control performed by a switching unit.

With reference to FIG. 12, the control of the driven roller 60 by using the switching unit 63 will be described below. When in a stand-by state in which the recording paper P is not transported, the switching unit 63 holds the driven roller 60 at the retracted position. Once a recording operation onto the recording paper P starts, when the leading edge of the recording paper P has reached the first transport roller pair 31 (Yes in step S101), the switching unit 63 switches the driven roller 60 from the retracted position to the advanced position (step S102) on the basis of the detection signal of the paper sheet detection sensor 38 (see FIG. 3). When it is determined that the leading edge of the recording paper P has reached the second transport roller pair 32 (Yes in step S103), the switching unit 63 switches the driven roller 60 from the advanced position to the retracted position (step S104).

With this configuration, the recording paper P whose leading edge is located between the first transport roller pair 31 and the second transport roller pair 32 can be reliably brought into contact with the reflecting surface 45*a*, and foreign substances such as paper dust attached to the reflecting surface 45*a* can be removed by the recording paper P. Further, when the leading edge of the recording paper P is not located at a position between the first transport roller pair 31 and the second transport roller pair 32, the driven roller 60 is held at the retracted position. Accordingly, the recording paper P is not always in contact with the reflecting surface 45*a*, and thus the reflecting surface 45*a* is not subject to abrasion damage by the recording paper P. In the present embodiment, the straight line Q1 intersects the reflecting surface 45*a*. However, even with the configuration in which it does not intersect, the recording paper P can be brought into contact with the reflecting surface 45*a* by the driven roller 60.

When transporting a plurality of sheets of the recording paper P, the switching unit 60 can control the driven roller 60 to be displaced from the retracted position to the advanced position during transport of a first recording paper P among the plurality of sheets of the recording paper P, and hold the driven roller 60 at the retracted position during transport of a second recording paper P, which is different from the first recording paper P, among the plurality of sheets of the recording paper P.

Figure 13:
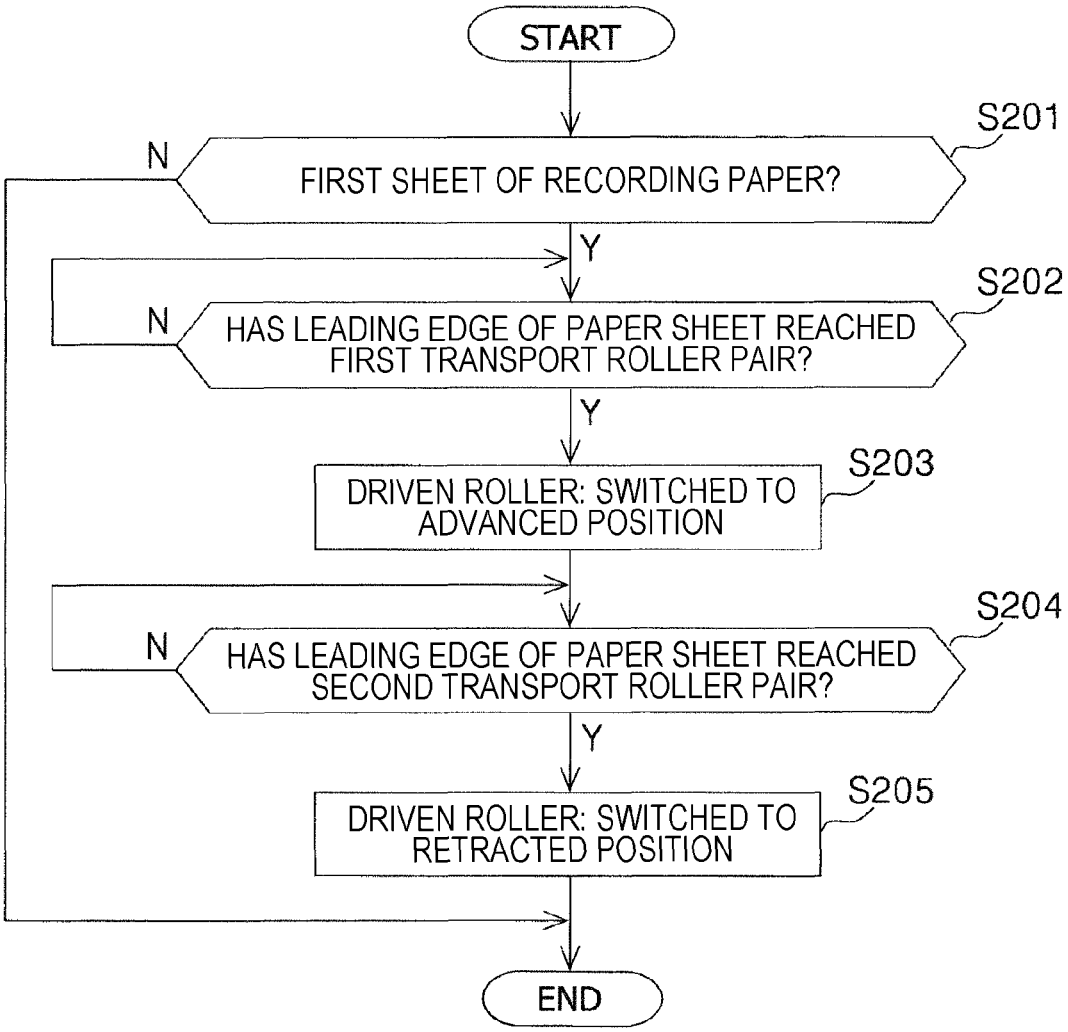
FIG. 13 is a flow chart another example of control performed by a switching unit.

FIG. 13 shows an example of such control, in which the switching unit 60, when transporting the plurality of sheets of the recording paper P, determines whether it is a first sheet of the recording paper P (step S201), and executes step S201 onward when it is a first recording paper P (Yes in step S201). Specifically, when it is determined that the leading edge of the recording paper P has reached the first transport roller pair 31 (Yes in step S202), the switching unit 63 switches the driven roller 60 from the retracted position to the advanced position (step S203) on the basis of the detection signal of the paper sheet detection sensor 38 (see FIG. 3). When the leading edge of the recording paper P has reached the second transport roller pair 32 (Yes in step S204), the switching unit 63 switches the driven roller 60 from the advanced position to the retracted position (step S205). That is, the driven roller 60 is displaced from the retracted position to the advanced position only for the first sheet of the recording paper P, and the driven roller 60 is held at the retracted position for the second and the subsequent sheets of the recording paper P.

According to such control, in transport of a plurality of sheets of the recording paper P, a period during which the recording paper P is in contact with the reflecting surface 45*a* can be further reduced to thereby further reliably reduce occurrence of abrasion damage to the reflecting surface 45*a* by the recording paper P abutting therewith. In addition, since the first sheet of the recording paper P is in contact with the reflecting surface 45*a* only during the period until the leading edge reaches the second transport roller pair 32, abrasion damage to the reflecting surface 45*a* by the recording paper P abutting therewith can be minimized. In addition, abrasion damage to the recording paper P by the reflecting surface 45*a* can also be reduced.

Figure 11:
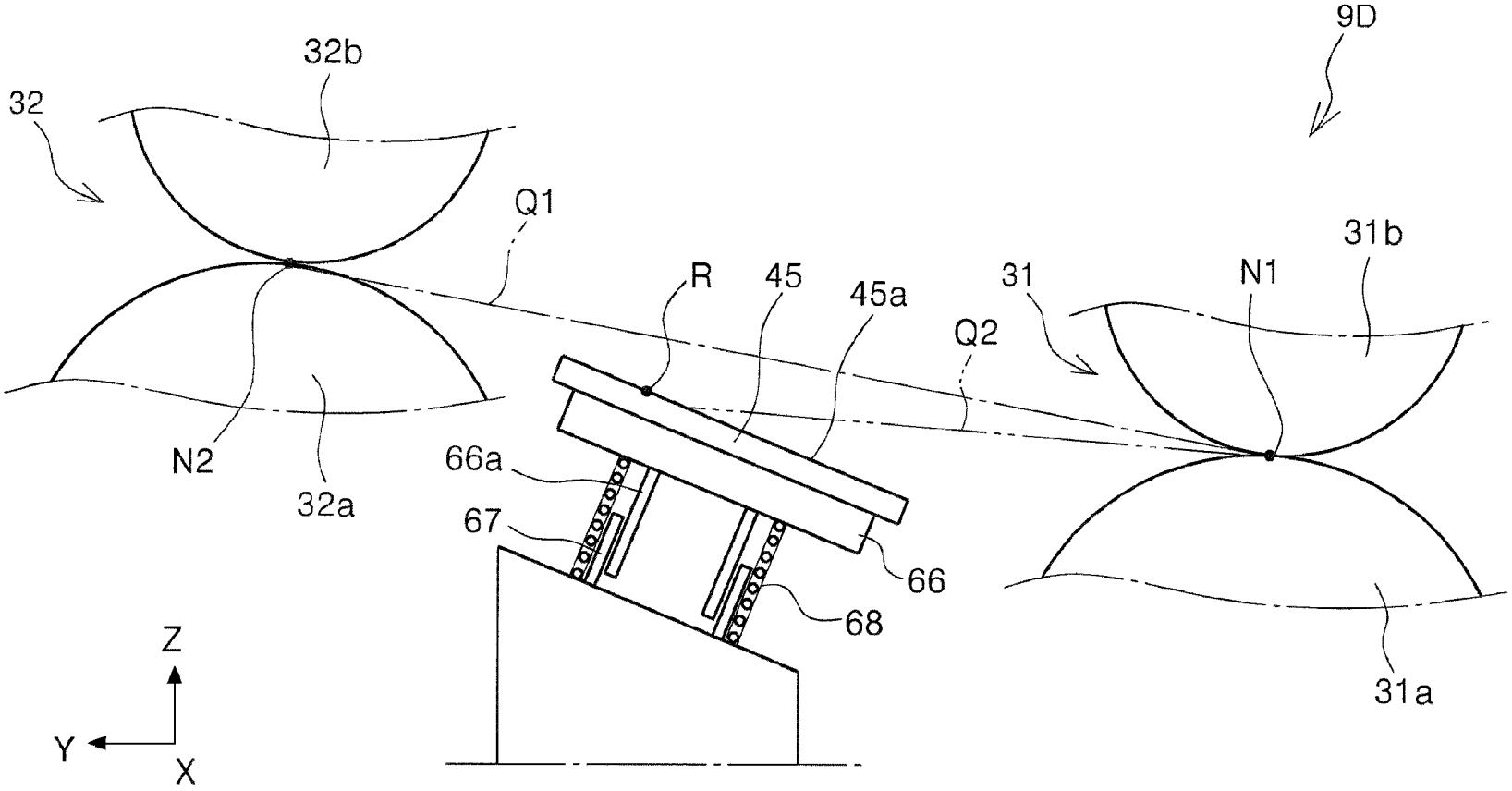
FIG. 11 is a view corresponding to the cross-sectional view taken along the line XI-XI of FIG. 6, illustrating another embodiment of a paper sheet transport device.

Referring now to FIG. 11, a paper sheet transport device 9D according to further another embodiment will be described. In the paper sheet transport device 9D, the reflector 45 is fixed to a fixation member 66. The fixation member 66 includes a guided section 66*a*, and, when the guided section 66*a* is guided by a guiding section 67, the reflector 45 is displaceable relative to the light emitting element 41 and the light receiving element 42, which face the reflector 45. In addition, the fixation member 66 is pressed by a pressing spring 68 toward the light emitting element 41 and the light receiving element 42, which face the fixation member 66. Accordingly, when the recording paper P is in strong contact with the reflecting surface 45*a*, the reflecting surface 45*a* can be retracted. As a result, abrasion damage to the reflecting surface 45*a* by the recording paper P can be reduced. Further, transport failure due to the leading edge of the recording paper P strongly abutting the reflecting surface 45*a* can be reduced.

If the posture of the reflecting surface 45*a* changes when the reflector 45 is displaced, the traveling direction of the recording paper P, which is fed downstream while being in contact with the reflecting surface 45*a*, may be disturbed. However, since the reflector 45 is displaced while keeping the posture of the reflecting surface 45*a* relative to the light emitting element 41 and the light receiving element 42 which face the reflector 45, traveling direction of the recording paper P can be appropriately maintained.

In the embodiments described above, the transport rate of the recording paper P by the second transport roller pair 32 is set to be higher than the transport rate of the recording paper P by the first transport roller pair 31. Accordingly, it is possible to prevent the recording paper P nipped between the first transport roller pair 31 and the second transport roller pair 32 from sagging between these roller pairs and contacting the reflecting surface 45*a*. As a result, abrasion damage to the reflecting surface 45*a* by the recording paper P can be reduced.

The present disclosure is not limited to the aforementioned embodiments. Various modifications can be made within the scope of the disclosure defined by the appended claims, and such modifications should be included in the scope of the disclosure. For example, in the above embodiments, the first optical element is composed of the light emitting element 41 and the light receiving element 42, while the second optical element is composed of the reflector 45. However, the first optical element may also be composed of the reflector 45, and the second optical element may also be composed of the light emitting element 41 and the light receiving element 42. Alternatively, without providing the reflector 45, the first optical element may be composed of the light emitting element 41 and the second optical element may be composed of the light receiving element 42, or the first optical element may be composed of the light receiving element 42 and the second optical element may be composed of the light emitting element 41. In this case, the second optical element is preferably provided with a cover that transmits detection light in order to prevent the recording paper P from being directly in contact with the second optical element. In this configuration, the recording paper P is in contact with a surface of the cover which faces the first optical element.

What is claimed is:

1. A medium transport device comprising:

a medium transport path that transports a medium, the medium transport path extending in a direction intersecting a vertical direction;

a first roller pair that imparts a feeding force to a medium in the medium transport path;

a second roller pair that imparts a feeding force to a medium in the medium transport path, the second roller pair being disposed downstream relative to the first roller pair in a medium transport direction; and a medium detection unit that detects a medium by using detection light intersecting the medium transport path, the medium detection unit being disposed between the first roller pair and the second roller pair in the medium transport path, wherein the medium detection unit is a component constituting an optical path of the detection light, and includes a first optical element disposed on an upper side of the medium transport path and a second optical element disposed on a lower side of the medium transport path so as to face the first optical element, the second optical element has a facing surface that faces the first optical element, the facing surface being located at a position that is not in contact with a medium nipped by both the first roller pair and the second roller pair, and a medium feeding direction by the first roller pair is a direction by which a leading edge of a medium fed out abuts a position upstream in the medium transport direction relative to a position where the detection light is received on the facing surface.

2. The medium transport device according to claim 1, wherein the facing surface is a flat surface, and has inclination in which a downstream end in the medium transport direction is located higher than an upstream end in the medium transport direction.

3. The medium transport device according to claim 2, wherein the facing surface is configured to guide a leading edge of a medium to a medium nip position in the second roller pair.

4. The medium transport device according to claim 1, wherein a transport rate of a medium by the second roller pair is higher than a transport rate of a medium by the first roller pair.

5. The medium transport device according to claim 1, further comprising a first rib that supports a medium on a first side of the facing surface in a width direction, which is a direction intersecting a medium transport direction, and a second rib that supports a medium on a second side of the facing surface, which is a side opposite to the first side in the width direction.

6. The medium transport device according to claim 1, wherein the second optical element is displaceable in a direction advanced and retracted with respect to the first optical element, and is pressed toward the first optical element.

7. The medium transport device according to claim 6, wherein the second optical element is displaced while keeping a posture of the facing surface relative to the first optical element.

8. The medium transport device according to claim 1, further comprising a first low-level section that is lower than the facing surface, which is a direction intersecting a medium transport direction, and a second low-level section that is lower than the facing surface, which is a side opposite to the first side in the width direction.

9. The medium transport device according to claim 1, the medium detection unit is a component constituting an optical path of the detection light, and includes a first optical element disposed on an upper side of the medium transport path and a second optical element disposed on a lower side of the medium transport path so as to face the first optical element, the second optical element has a facing surface that faces the first optical element, the facing surface being located at a position that is not in contact with a medium nipped by both the first roller pair and the second roller pair, the medium transport device includes a contact unit that is displaceable between a first position that is advanced toward the facing surface and a second position that is retracted from the first position, farther away from the facing surface, and the contact unit is configured to bring a medium whose leading edge at the first position is located between the first roller pair and the second roller pair into contact with the facing surface.

10. The medium transport device according to claim 9, wherein the contact unit is switched between the first position at which the contact unit is pressed toward the facing surface and causes a leading edge of a medium located between the first roller pair and the second roller pair to be in contact with the facing surface, and the second position at which the contact unit is pushed up by a medium nipped by the first roller pair and the second roller pair and causes the medium not to be in contact with the facing surface.

11. The medium transport device according to claim 9, further comprising a switching unit that switches a position of the contact unit, wherein the switching unit causes the contact unit to be located at the first position in a state in which a leading edge of a medium is located between the first roller pair and the second roller pair, and causes the contact unit to be located at the second position after a leading edge of the medium reaches the second roller pair.

12. The medium transport device according to claim 9, further comprising a switching unit that switches a position of the contact unit, wherein the switching unit, when transporting a plurality of media, displaces the contact unit from the second position to the first position during transport of a first medium among the plurality of media, and holds the contact unit at the second position during transport of a second medium, which is different from the first medium among the plurality of media.

13. The medium transport device according to claim 12, wherein the first medium is a medium that is first transported among the plurality of media.

14. The medium transport device according to claim 12, wherein the switching unit causes the contact unit to be located at the first position in a state in which a leading edge of the first medium is located between the first roller pair and the second roller pair, and causes the contact unit to be located at the second position after a leading edge of the first medium reaches the second roller pair.

15. The medium transport device according to claim 9, wherein the contact unit is composed of a driven roller that is driven while being in contact with a medium.

16. A recording apparatus comprising:

a recording unit that performs recording onto a medium; and the medium transport device according to claim 1, the medium transport device being configured to transport a medium.

* * * * *